US005365209A

United States Patent [19]

Ito et al.

[11] Patent Number: 5,365,209

[45] Date of Patent: Nov. 15, 1994

[54] DIELECTRIC FILTERS AND DUPLEXERS INCORPORATING SAME

[75] Inventors: Atsushi Ito, Higashiosaka; Yasuhiko Okamoto, Osaka, both of Japan

[73] Assignee: Sanyo Electric Co., Ltd., Osaka, Japan

[21] Appl. No.: 43,463

[22] Filed: Apr. 2, 1993

[30] Foreign Application Priority Data

| | | | |
|---|---|---|---|
| Apr. 3, 1992 | [JP] | Japan | 4-082106 |
| Jan. 12, 1993 | [JP] | Japan | 5-003426 |
| Feb. 1, 1993 | [JP] | Japan | 5-014753 |
| Feb. 19, 1993 | [JP] | Japan | 5-030538 |

[51] Int. Cl.[5] ..... H01P 1/205

[52] U.S. Cl. ..... 333/206; 333/202

[58] Field of Search ..... 333/202, 203, 206, 207, 333/222, 223, 246, 219, 243

[56] References Cited

U.S. PATENT DOCUMENTS

| | | | |
|---|---|---|---|
| 4,179,673 | 12/1970 | Nishikawa et al. | 333/202 X |
| 4,829,274 | 5/1989 | Green et al. | 333/202 |

FOREIGN PATENT DOCUMENTS

| | | | |
|---|---|---|---|
| 0336255 | 10/1989 | European Pat. Off. . | |
| 0448085A2 | 9/1991 | European Pat. Off. . | |
| 0038601 | 2/1987 | Japan | 333/202 |
| 0278401 | 11/1988 | Japan | 333/202 |
| 0019001 | 1/1990 | Japan | 333/206 |
| 0167701 | 6/1992 | Japan | 333/206 |

OTHER PUBLICATIONS

Patent Abstract of Japan vol. 8, No. 13 (E-222) (1450), Jan. 20, 1984 & JP-A-58 178 601 (Nihon Dengiyou Kousaku K.K.) Oct. 19, 1983 (abstract).

*Primary Examiner*—Seungsook Ham

*Attorney, Agent, or Firm*—Armstrong, Westerman, Hattori, McLeland & Naughton

[57] ABSTRACT

Coaxial resonators serving as input and output stages are arranged on a dielectric substrate having input and output coupling strip lines and a grounding electrode formed in the same plane as the strip lines and surrounding the strip lines. The substrate is shaped substantially in conformity with the bottom contour of the resonators as arranged on the substrate.

12 Claims, 15 Drawing Sheets

FIG. 3
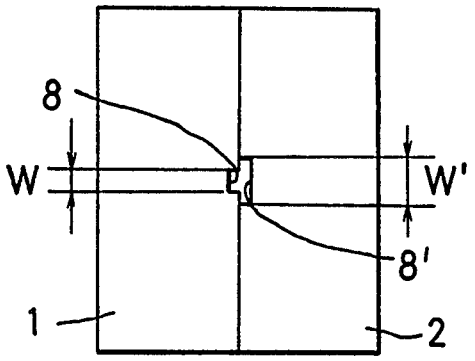
FIG. 4(A)
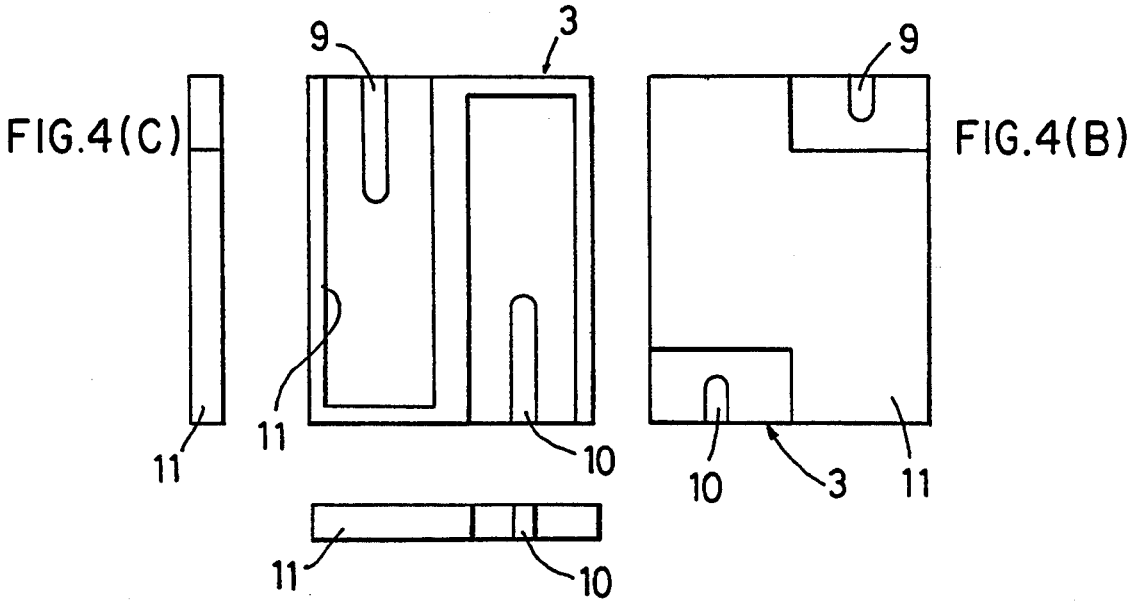
FIG. 4(D)

DIELECTRIC FILTERS AND DUPLEXERS INCORPORATING SAME

BACKGROUND OF THE INVENTION

1. Field of the Invention

The present invention relates to dielectric filters for use in mobile communication systems for the microwave band, and duplexers having such filters incorporated therein for use in radio devices.

2. Description of the Related

Conventional dielectric filters wherein coaxial resonators are used include, for example, the one disclosed in Examined Japanese Utility Model Publication No. 44566/1987 (FIG. 28). The disclosed dielectric filter comprises a plurality of quarter-wavelength coaxial resonators 1 each including a dielectric member 12 which has a through hole 4. The outer peripheral surface of the dielectric member and the inner peripheral surface thereof defining the through hole are covered with an electrically conductive material to provide an outer conductor 5 and an inner conductor 6, respectively. The dielectric member has an open end face 1*a* where the outer conductor 5 and the inner conductor 6 each have an open end, and a short-circuit end face 1*b* where the other ends of the conductors are short-circuited.

A connecting member comprising a dielectric bush 14 and a connecting bar 15 is fitted in the through hole 4 of each coaxial resonator 1, and the other end of the bar 15 is joined to a coupling electrode 13 on a substrate 16, whereby the dielectric filter is capacitance-coupled to an external circuit.

It has been required in recent years that mobile communication devices be made smaller in size and lightweight. To comply with this requirement, the dielectric filter, one of the components of these devices, also need to be made more compact.

In providing compact dielectric filters, the ratio of the diameter of the inner conductor 6 to the outer conductor 5 must be 3.6 in order to obtain a high Qu value (no-loaded Q factor). If the diameter of the outer conductor 5 is up to 4 mm, the diameter of the inner conductor 6 is up to 1.1 mm, whereas extreme difficulties are encountered in the prior art in inserting the connecting members 14, 15 into the through hole 4 of the coaxial resonator for connection to the external circuit 13. Thus, making the dielectric filter compact becomes difficult.

In mobile communication devices, on the other hand, signals of different frequencies are separated according to the frequency or are combined together using duplexers. Such duplexers comprise a transmitting dielectric filter and a receiving dielectric filter which are different in center frequency. With the trend of mobile communication toward higher frequencies, the difference between the receiving band and the transmitting band in the center frequency becomes smaller, making it difficult for these dielectric filters to attain the desired attenuation outside the pass band. Accordingly, the characteristics of the dielectric filters for use in the duplexer must involve a local minimum of attenuation.

The present applicant filed a patent application with the Patent Office of Japan for a dielectric filter which is free of the above problem and which has the construction shown in FIG. 29 (Japanese Patent Application No. 46796/1991). A U.S. patent has been granted for the filter as U.S. Pat. No. 5,144,269.

This dielectric filter comprises a plurality of coaxial resonators 1 arranged side by side and each having a dielectric member 12 formed with a through hole 4. The outer and inner peripheral surfaces of the dielectric member 12 are covered with a conductive material to provide an outer conductor 5 and an inner conductor 6, respectively. The resonator has a short-circuit end face and an open end face, in the vicinity of which the outer conductor 6 is partially removed, along with a portion of the dielectric member when so desired, to form a recess 17. A dielectric substrate 19 provided with an external connection electrode 18 is attached to the recessed portion 17.

At least three coaxial resonators are used in the filter to provide a local minimum of attenuation. More specifically, a capacitance is formed between the external connection electrode 18 and a capacitance-forming electrode provided on the dielectric substrate 19 to obtain frequency characteristics involving a local minimum in the attenuation region.

With the filter described above, however, the resonator needs machining for forming the recessed portion 17 for attaching the dielectric substrate thereto and therefore can not be made compact without limitations. The characteristics of the filter also have the problem that sufficient suppression is not available outside the pass band.

The dielectric filter has another problem in that the coaxial resonator can not be reduced in its overall length because the substrate 19 needs to be partly projected from the dielectric member 12 for coupling to an external circuit.

SUMMARY OF THE INVENTION

The present invention provides a dielectric filter of reduced size which comprises a substrate having approximately the same shape and area as the bottom contour of an arrangement of coaxial resonators and wherein the arrangement of resonators is mounted on the substrate in register therewith without permitting the substrate to project beyond the resonators.

An object of the present invention is to provide a dielectric filter which is reduced in size and which has excellent characteristics involving a local minimum of attenuation to attain the desired attenuation outside the pass band.

Another object of the invention is to provide a duplexer comprising such dielectric filters as transmitting and receiving filters.

The present invention provides a dielectric filter which is characterized in that the filter comprises a dielectric substrate having input and output coupling strip lines on a surface thereof, and a plurality of coaxial resonators, each of the resonators comprising a dielectric member having a through hole, an outer peripheral surface and an inner peripheral surface, the outer and inner peripheral surfaces being covered with an electrically conductive material to provide an outer conductor and an inner conductor, respectively, the outer conductor being partially removed, the plurality of coaxial resonators including an input resonator and an output resonator arranged on the dielectric substrate with open end faces thereof oriented in directions opposite to each other, the dielectric substrate being shaped in conformity with the bottom contour of the plurality of coaxial resonators as arranged on the substrate.

The present invention also provides a duplexer which comprises a receiving filter and a transmitting filter each comprising three coaxial resonators serving respectively as an input stage, an output stage and an intermediate stage, each of the resonators having the above construction, and a dielectric substrate provided with input and output coupling strip lines for transmitting therethrough inputs and outputs of the coaxial resonators and with a receiving matching circuit and a transmitting matching circuit for connecting the receiving filter and the transmitting filter to one antenna.

BRIEF DESCRIPTION OF THE DRAWINGS

FIG. 3 is a plan view showing the first embodiment of dielectric filter;

FIG. 4, (A) to (D) are projection drawings of different surfaces of a dielectric substrate for use in the first embodiment;

DETAILED DESCRIPTION OF THE INVENTION

First Embodiment

FIGS. 1 to 7 show a dielectric filter of a first embodiment of the present embodiment, which comprises two coaxial resonators 1, 2 and a dielectric substrate 3.

Figure 2:
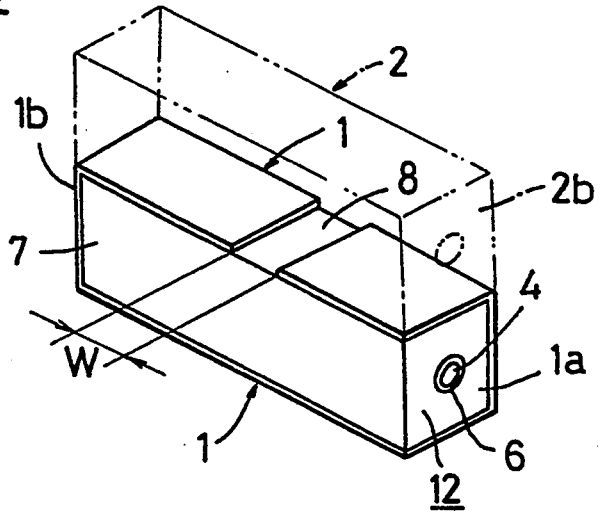
FIG. 2 is a perspective view showing coaxial resonators for use in the invention.

Each of the two coaxial resonators 1, 2 is a quarter-wavelength coaxial resonator, which comprises, as shown in FIG. 2, a dielectric member 12 in the form of a prism and having a through hole 4. The outer and inner peripheral surfaces of the dielectric member 12 are covered with silver or like electrically conductive material to provide an outer conductor 5 and an inner conductor 6, respectively. One end face of the resonator is covered with the conductive material to provide a short-circuit end face **1*b* where the outer and inner conductors 5, 6 are short-circuited. The dielectric member is left exposed at the other end face of the resonator to provide an open end face 1*a*. The two resonators 1, 2 are arranged side-by-side and joined together by soldering, with their open end faces oriented in directions opposite each other. The outer conductor is removed from the bottom of the assembly to form a bottom portion 7**.

Each of the coaxial resonators 1, 2 is adapted for use with frequencies in the range of several hundreds of MHz to 3 GHz. The resonator has a square cross section measuring slightly less than 2.0 mm in each side, is 0.7 mm in the diameter of the through hole 4 and has a length which is 4.2 mm when it is used for a frequency of 1.9 GHz.

The two coaxial resonators 1, 2 are formed in the center of their adjacent surfaces with interstage coupling windows 8, 8', respectively, by removing the outer conductors 5 perpendicular to the direction of the through holes 4. As shown in FIG. 3, the windows 8 and 8' have widths W and W', respectively, which are different from each other. Accordingly, even if the two resonators 1, 2 are joined together by soldering as slightly displaced from each other, the assembly has a definite effective interstage coupling width, and the degree of coupling will not vary from product to product.

The coaxial resonators 1, 2 are placed on the dielectric substrate 3 with the bottom portion 7 down and with their open end faces **1*a*, 2*a*** oriented in directions opposite to each other.

FIG. 4 shows the dielectric substrate 3. FIG. 4, (A) shows the front surface of the substrate, FIG. 4, (B) the rear surface thereof, and FIG. 4, (C) and (D) side faces thereof.

Figure 1:
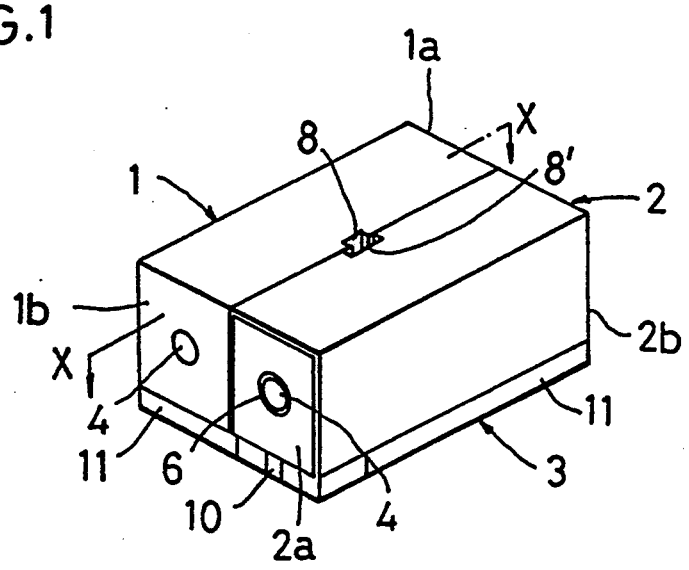
FIG. 1 is a perspective view showing a first embodiment of dielectric filter.
Figure 1A:
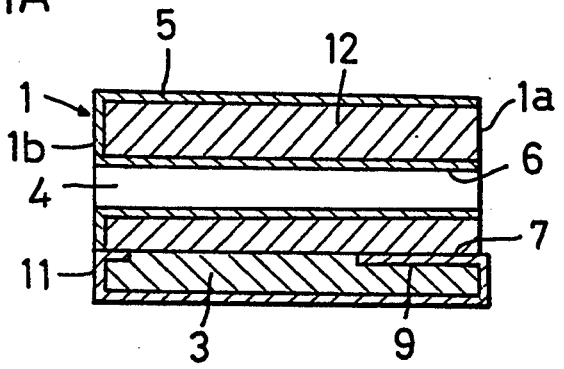
FIG. 1A is a view in section taken along the line X—X in FIG. 1.

The substrate 3 has approximately the same shape and area as the contour of the bottom portion 7 of assembly of the two resonators 1, 2 as arranged side-by-side as shown in FIG. 1. Input and output coupling strip lines 9, 10 are formed on the front and rear surfaces of the dielectric substrate 3, whereby the resonators 1, 2 are connected to an external circuit for input-output coupling. Indicated at 11 is a grounding electrode extending along the side end faces of the substrate 3 to electrically connect the front surface to the rear surface, and is provided around the input coupling strip line 9 and the output coupling strip line 10 to prevent electrical interference between the strip lines 9, 10.

As shown in FIG. 1, the resonators 1, 2 have their open end faces 1*a*, 2*a* positioned on the input and output coupling strip lines 9, 10, respectively, and are affixed to the dielectric substrate 3 with an epoxy or like adhesive. The outer conductors 5 of the resonators 1, 2 are thereafter soldered to the grounding electrode 11 on the substrate 3. Thus, the dielectric filter is completed.

Figure 5:
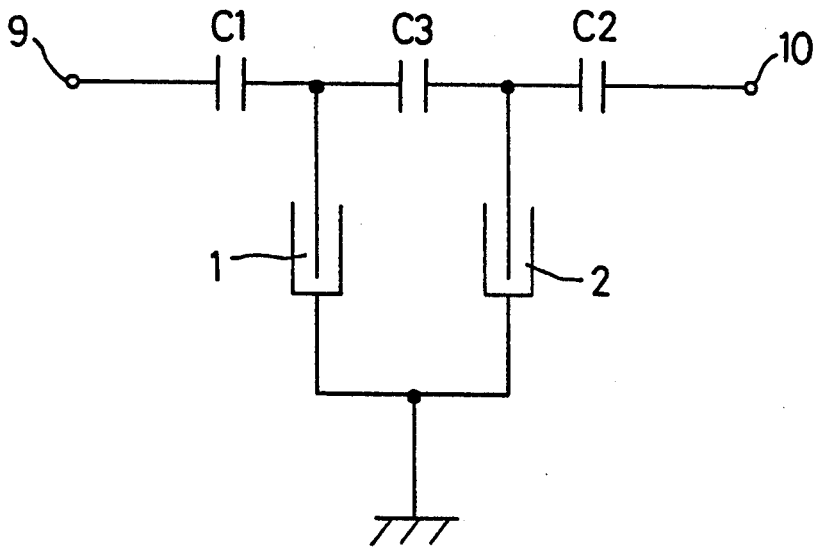
FIG. 5 is an equivalent circuit diagram of the first embodiment.
Figure 6:
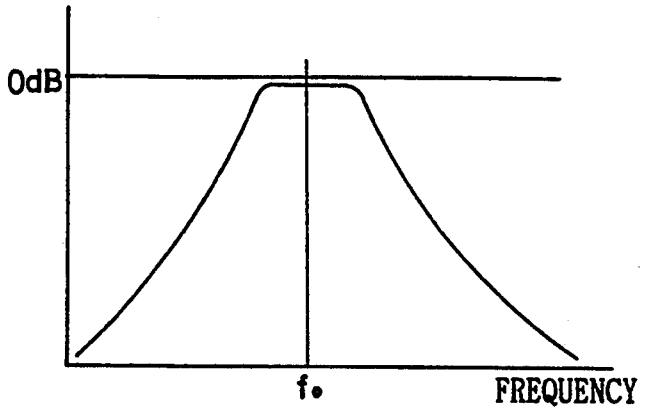
FIG. 6 is a graph showing the filter characteristics of the first embodiment.

The dielectric filter thus constructed is shown in FIG. 5 as an equivalent circuit. Capacitances C1, C2 are formed between the inner conductors 6 of the coaxial resonators 1, 2 and the respective input and output coupling strip lines 9, 10 for capacitance coupling. A capacitance C3 is formed by the inner conductors 6, 6 of the resonators 1, 2 owing to the presence of the interstage coupling windows 8, 8′ for capacitance coupling, whereby a filter is provided. The filter characteristics of this embodiment are shown in FIG. 6.

Figure 28:
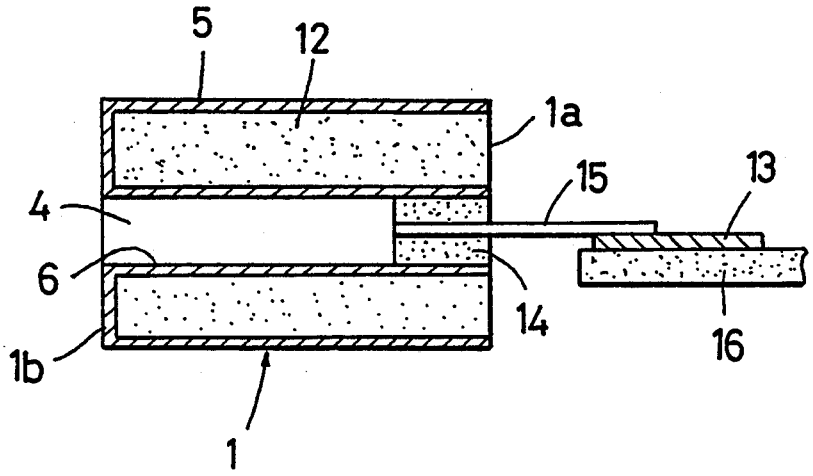
FIG.28 (PRIOR ART)
FIG. 28 is a sectional view of a conventional dielectric filter.
Figure 29:
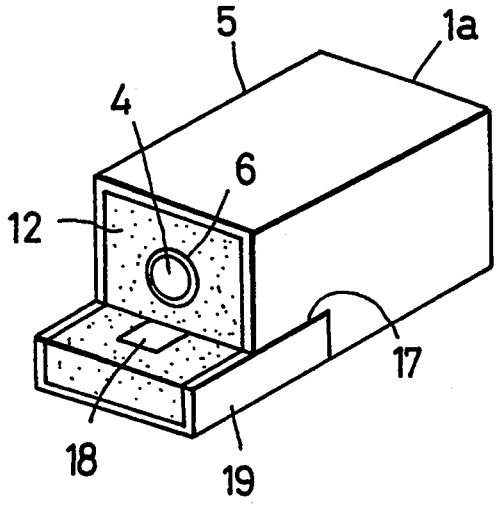
FIG.29 (PRIOR ART)
FIG. 29 is a perspective view of a dielectric filter already filed for application by the present inventors.

The dielectric substrate 3 has approximately the same area and contour as the bottom portion of assembly of the two coaxial resonators 1, 2 and does not have the portion 15 greatly projecting outward unlike the conventional filter (FIG. 28). When incorporating the present filter, communication devices can therefore be made smaller in size.

Figure 7:
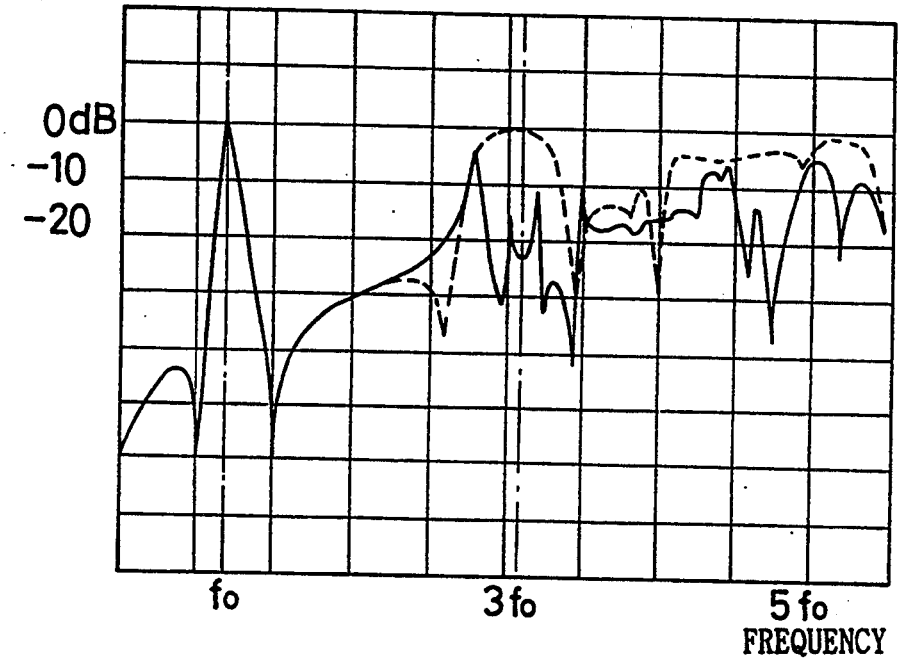
FIG. 7 is a graph showing higher-order pass band characteristics of the first embodiment.

FIG. 7 shows the higher-order pass band characteristics of the present embodiment. The solid line represents the dielectric filter of the invention, and the broken line the prior-art device (FIG. 28). According to the present invention, coaxial resonators serving as an input stage and an output stage are arranged on a dielectric substrate with their open end faces spaced apart as oriented in opposite directions. This eliminates matching at 3 fo and 5 fo owing to variations in higher-order frequency, affording improved ability to suppresss waves other than the dominant wave.

Second Embodiment

FIGS. 8 to 12 show a second embodiment of the invention which also comprises the coaxial resonators 1, 2 shown in FIG. 2.

Figure 8:
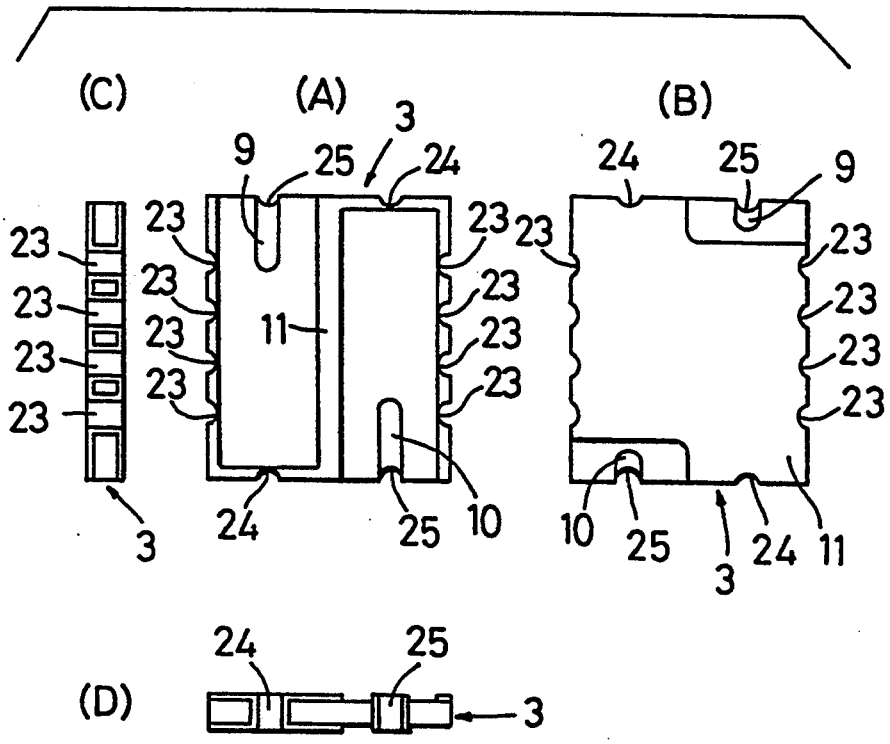
FIG. 8, (A) to (D) are projection drawings of different surfaces of a dielectric substrate for use in a second embodiment.

The dielectric substrate 3 to be used in the present embodiment is shown in FIG. 8. The front surface of the substrate for placing the resonators 1, 2 thereon is shown in FIG. 8, (A), the rear surface thereof in FIG. 8, (B) and side faces thereof in FIG. 8, (C) and (D). The dielectric substrate 3 has approximately the shape and area as the contour of the bottom portion of arrangement of the two coaxial resonators 1, 2. Indicated at 9, 10 are input and output coupling strip lines, through which the resonators 1, 2 are connected to an external circuit for input-output coupling. Indicated at 11 is a grounding electrode provided on the resonator bearing surface of the substrate formed with the strip lines 9, 10 so as to surround these strip lines 9, 10. The electrode 11 is electrically connected to a grounding electrode formed approximately over the entire rear surface of the substrate, on the front and rear surfaces by means of through holes 23 and through holes 24. The electrode 11 also serves to obviate electrical interference between the input coupling strip line 9 and the output coupling strip line 10. Each of the input and output coupling strip lines 9, 10 is electrically connected to a corresponding one on the rear surface by a through hole 25.

Figure 9:
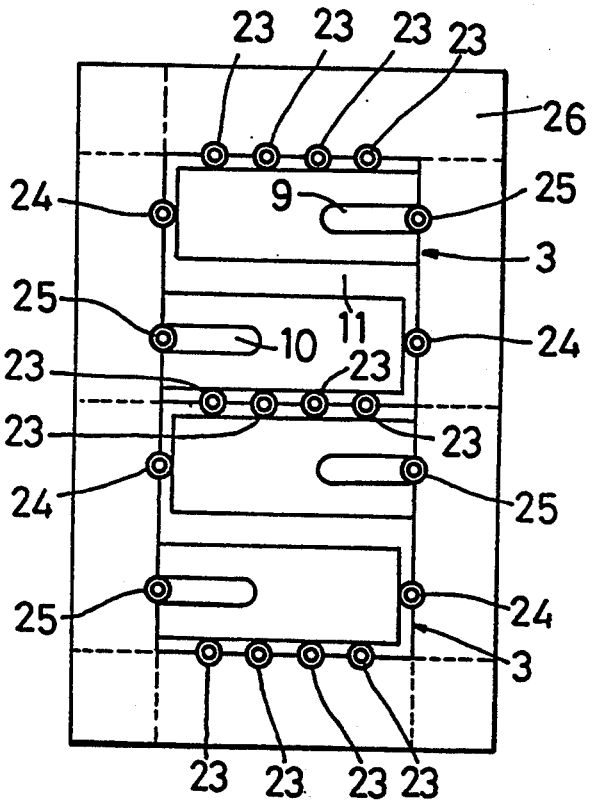
FIG. 9 is a plan view showing dielectric substrates while they are being prepared for use in the second embodiment.

FIG. 9 shows the front surface of dielectric substrates 3, 3 in the course of preparation. These substrates 3, 3 are formed by printing input and output strip lines 9, 10 and grounding electrode 11 on each of opposite surfaces of a substrate blank 26 of dielectric material, printing a grounding electrode on the rear surface of the blank 26, forming through holes 23 and 24 for connection and through holes 25 for inputting and outputting in the blank 26, and cutting the blank along the broken lines shown in the drawing.

Figure 10:
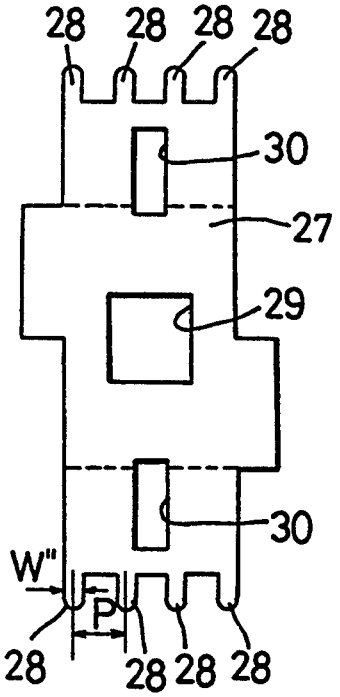
FIG. 10 is a view showing a cover for use in the second embodiment.

FIG. 10 shows an electrically conductive cover 27, which is prepared by blanking out a piece of the illustrated configuration from a conductive member and thereafter bending the piece along the broken lines shown. The conductive cover 27 has a plurality of connecting end portions 28 resembling comb teeth and formed at each of its opposite ends by blanking, and an interstage coupling degree adjusting window 29 and soldering windows 30 formed approximately at the center of the cover by punching. The pitch P of the connecting end portions 28 is equal to the pitch of the through holes 23 in the dielectric substrate. The end portions 28 have a width W″ which is equal to or slightly smaller than the diameter of the through holes 23. Suitable for the material of the conductive member is copper or like material having high conductivity, while in view of the coefficient of expansion and strength, it is suitable to use a copper alloy. The material is most suitably a copper alloy comprising up to 0.2 wt. % of Fe, up to 0.1 wt. % of P, up to 1.0 wt. % of Sn and the balance Cu.

The second embodiment of the invention is assembled in the manner to be described below with reference to FIG. 11. The coaxial resonators 1, 2 are arranged with their open end faces 1*a*, 2*a* oriented in directions opposite to each other and with these faces 1*a*, 2*a* lapping over the respective input and output coupling strip lines 9, 10. The bottom portion 7 of the arrangement is affixed to the dielectric substrate 3 with an epoxy resin or like adhesive, with a cream solder applied to the outer conductors 5 of the two resonators 1, 2.

The conductive cover 27 is then placed over the resonators 1, 2. At this time, the connecting end portions 28 fit into the through holes 23 in the substrate 3 and are temporarily fixed in position. The resulting assembly is then heated in a reflow oven and soldered with the cream solder applied. This procedure electrically connects the outer conductors 5 of the resonators 1, 2 to the cover 27 and the end portions 28 of the cover 27 to the through holes 23 to connect the outer conductors 5 of the resonators 1, 2 to the grounding electrodes 11, 11 of the substrate 3.

The interstage coupling window 8 is thereafter trimmed with a diamond bar or the like through the coupling degree adjusting window 29 formed in the cover 27 to thereby adjust the pass band characteristics. Finally, a seal member 31 is affixed to the cover 27 to assure the filter of reliability. If a material having an aluminum or like metal layer formed by vacuum evaporation is used as the seal member, a leakage magnetic field will penetrate through the seal member to entail an increased energy loss, which results in problems such as an increased insertion loss and variations in the center frequency. It is therefore desired to use resin, paper or like insulating material for the seal member 31.

With the dielectric filter of the present embodiment, the outer conductors of the coaxial resonators serving as an input stage and an output stage are electrically connected to the grounding electrode via the comb-toothed connecting end portions of the cover and through holes in the dielectric substrate, so that the resonators can be connected to the substrate with good stability, assuring a filter of high performance free of variations in its characteristics and impairment of the characteristics due to variations in the grounding condition.

Third and Fourth Embodiments

Figure 13:
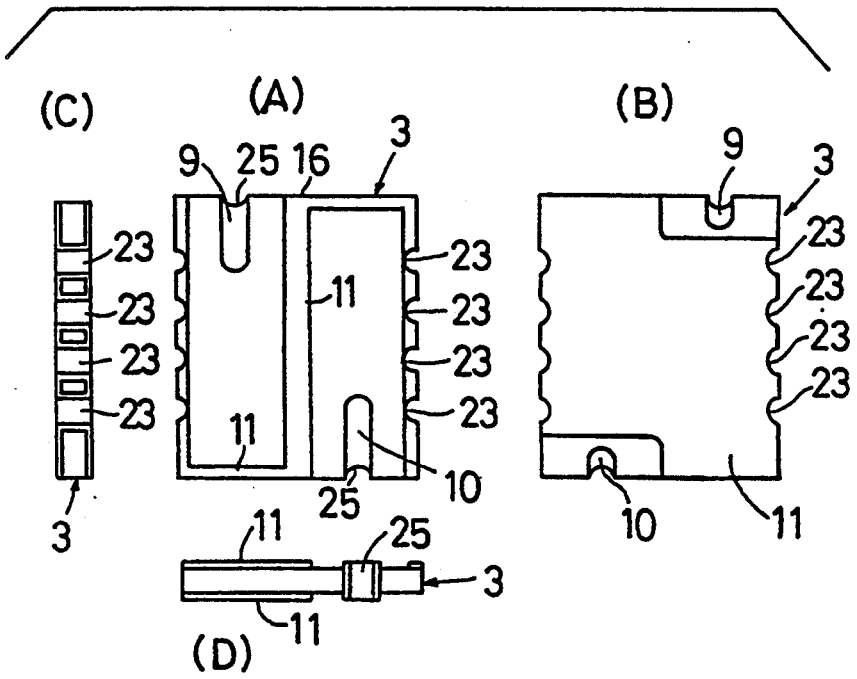
FIG. 13, (A) to (D) are projection drawings showing different surfaces of a dielectric substrate for use in a third embodiment.
Figure 14:
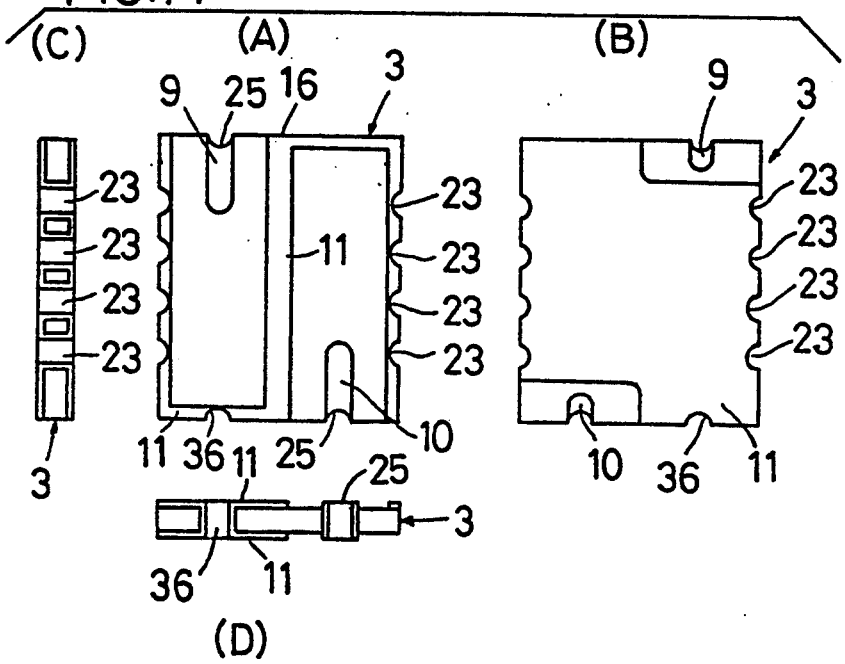
FIG. 14, (A) to (D) are projection drawings showing different surfaces of a dielectric substrate for use in a fourth embodiment.

FIGS. 13 and 14 show other dielectric filters of the invention, i.e., third and fourth embodiments, respectively. More specifically, each of these drawings shows the dielectric substrate 3 to be used in the embodiment. Throughout FIGS. 8, 13 and 14, like parts are designated by like reference numerals and will not be described again. In FIGS. 13 and 14, (A) shows the front surface for placing coaxial resonators 1, 2 on, (B) shows the rear surface, and (C) and (D) show side faces.

With the third embodiment shown in FIG. 13, a grounding electrode 11 provided so as to surround the input and output coupling strip lines 9, 10 is electrically connected to a grounding electrode 11 formed approximately over the entire rear surface of the dielectric substrate 3 by means of a plurality of through holes 23 formed in each of right and left opposite side faces of the substrate 3 where the strip lines 9, 10 are not formed.

With the fourth embodiment shown in FIG. 14, a grounding electrode 11 provided around the input and output coupling strip lines 9, 10 is electrically connected to a grounding electrode 11 formed approximately over the entire rear surface of the dielectric substrate 3 by means of through holes 23 formed in the right and left opposite side faces of the substrate 3 having neither of the strip lines 9, 10 and also by means of a through hole 36 formed in one of the front and rear side faces having the input and output coupling strip lines 9, 10, respectively.

Figure 11:
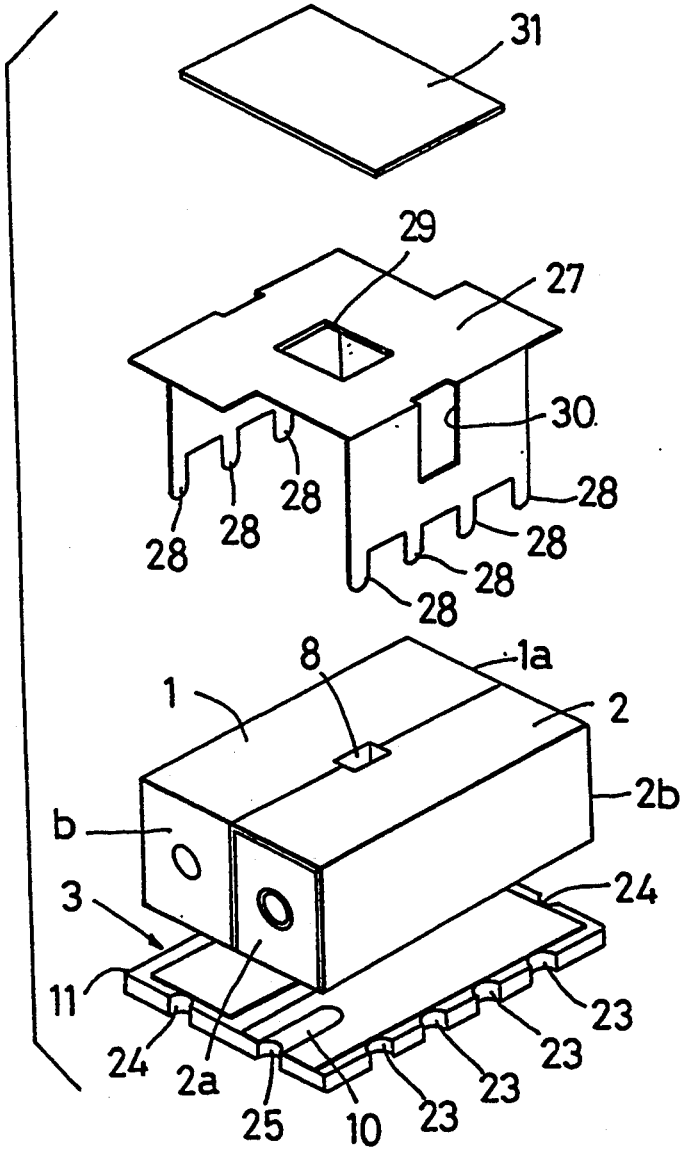
FIG. 11 is an exploded perspective view showing the components to be assembled into the second embodiment.
Figure 12:
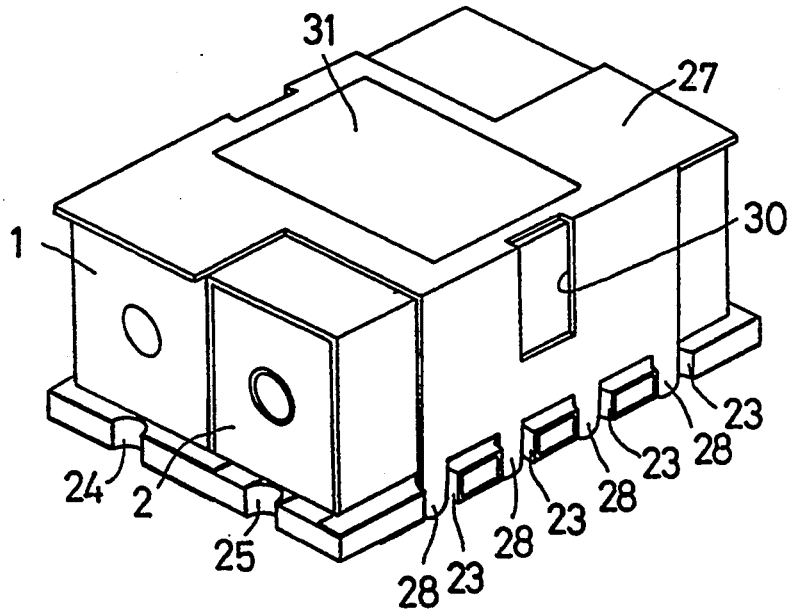
FIG. 12 is a perspective view showing the second embodiment.

Each of these dielectric substrates thus obtained is used to assemble a dielectric filter like the second embodiment shown in FIG. 11.

Figure 15:
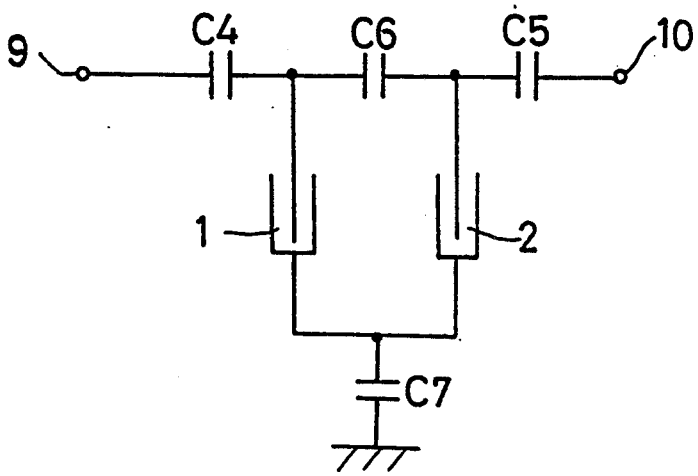
FIG. 15 is an equivalent circuit diagram of the third and fourth embodiments.

FIG. 15 shows an equivalent circuit diagram of the dielectric filters thus constructed. Indicated at C4 and C5 are coupling capacitances formed between the inner conductors of the coaxial resonators 1, 2 and the respective input and output coupling strip lines 9, 10 on the dielectric substrate 3. Indicated at C6 is a coupling capacitance between the coaxial resonators provided by the interstage coupling window 8 formed in the resonators 1, 2, and at C7 is a coupling capacitance formed between the outer conductors 5 of the resonators 1, 2 and the grounding electrode 11 on the rear surface of the substrate 3. The value of C7 is dependent on the strength of electrical coupling between the outer conductors 5 of the resonators 1, 2 and the rear grounding electrode 11 on the substrate 3, i.e., the presence or absence of the through holes 23 and 36, whereby the characteristics of the dielectric filter is made to have a local minimum of attenuation.

Figure 16:
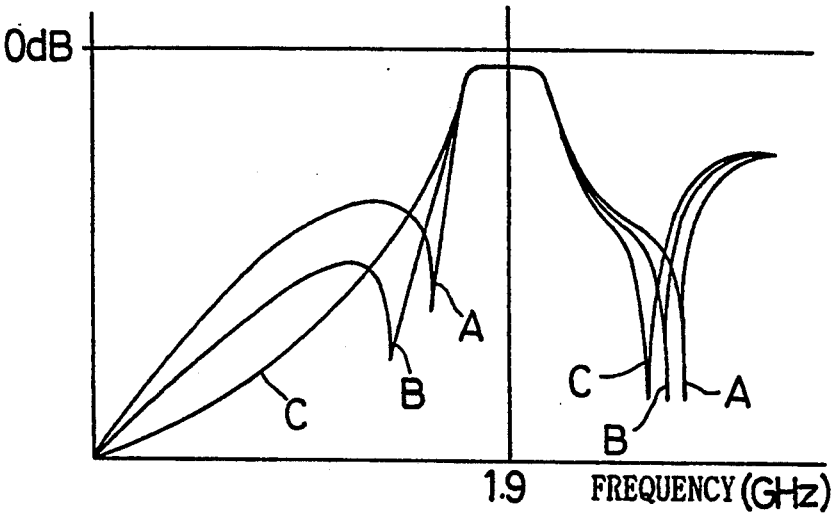
FIG. 16 is a graph showing the filter characteristics of the first, second, third and fourth embodiments.

FIG. 16 shows the filter characteristics of dielectric filters of the present invention. With reference to the drawing, A respresents the case wherein the dielectric substrate 3 of the third embodiment FIG. 13) is used, the substrate 3 having the through holes 23 only in the right and left opposite side faces thereof. B represents the case wherein the dielectric substrate 3 of the fourth embodiment (FIG. 14) is used, the substrate having, in addition to the through holes 23, the through hole 36 formed in one of the front and rear side faces having the strip lines 9, 10 respectively. C represents the characteristics of the first embodiment shown in FIG. 1 and the second embodiment shown in FIG. 12. Reliable electrical coupling is achieved between the outer conductors 5 of the coaxial resonators 1, 2 and the rear grounding electrode 11 on the substrate.

As represented by A and B in FIG. 16, the position of local minimum in the attenuation region is controllable according to the strength of electrical coupling between the resonator outer conductors 5 and the rear grounding electrode 11 on the dielectric substrate 3, i.e., according to presence or absence of the through hole 36 in one of the front and rear side faces having the strip lines 9, 10.

Fifth Embodiment

Figure 17:
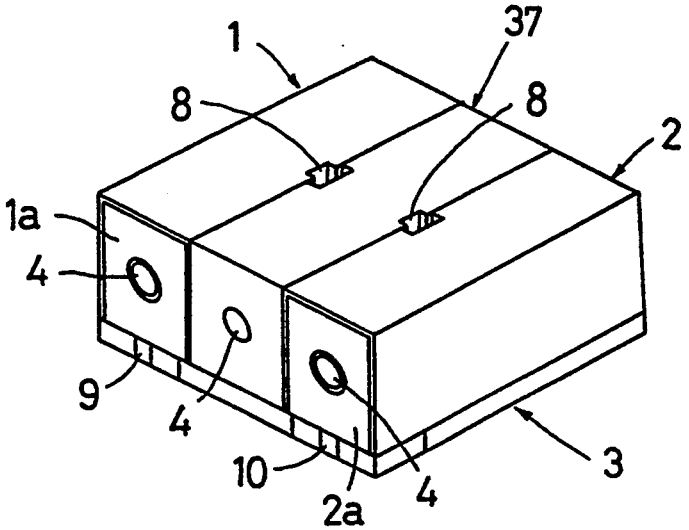
FIG. 17 is a perspective view of a fifth embodiment.
Figure 18:
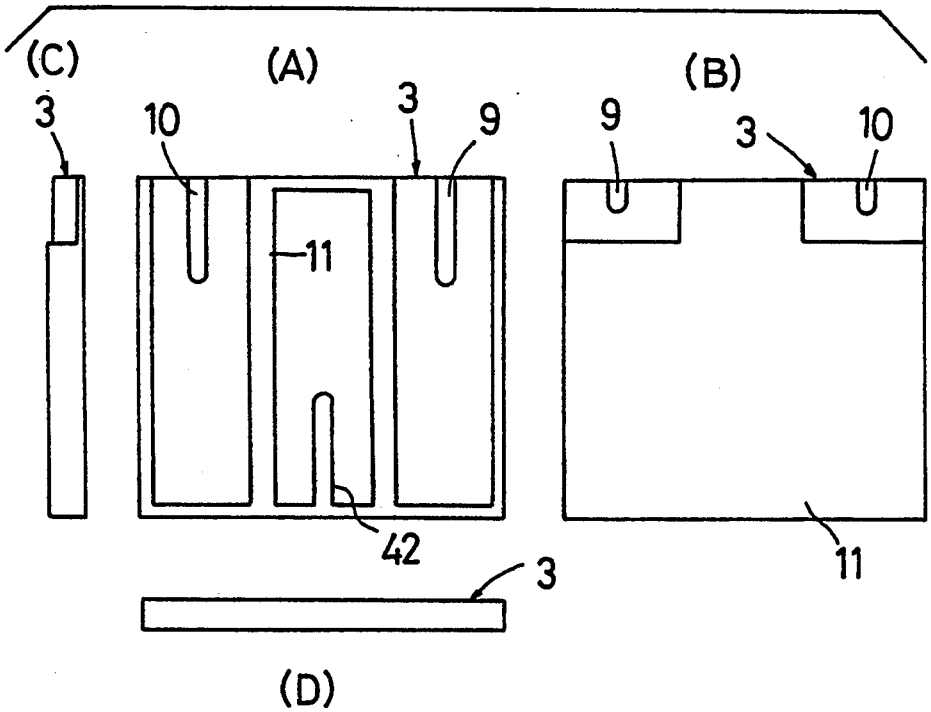
FIG. 18, (A) to (D) are projetion drawings showing different surfaces of a dielectric substrate for use in the fifth embodiment.

FIG. 17 shows a fifth embodiment of the present invention which comprises three coaxial resonators, i.e., coaxial resonoators 1, 2 of input and output stages, and a coaxial resonators 37 of intermediate stage interposed between the resonators 1, 2. The resonators 1, 2 and 37 are arranged on a dielectric substrate 3. As shown in FIG. 18, the substrate 3 has a grounding electrode or pattern 11 surrounding input and output coupling strip lines 9, 10 and electrically connected at side faces of the substrate to a grounding pattern 11 formed substantially over the entire rear surface of the substrate. Alternatively, these grounding patterns 11, 11 may be connected together by means of through holes as in the second embodiment shown in FIG. 8. The input and output coupling strip lines 9, 10 extend from one side of the dielectric substrate 3 toward one direction. Indicated at 42 is a resonator length correcting strip line for making the length of the resonator 37 of intermediate stage to that of the resonators 1, 2 of input and output stages. The coaxial resonators 1, 37 and 2 are arranged as oriented alternately in opposite directions. The resonators are first fixed onto the substrate 3 with an adhesive, and the outer conductors are thereafter soldered to the grounding electrode 11 on the substrate 3 for electrical connection.

Figure 19:
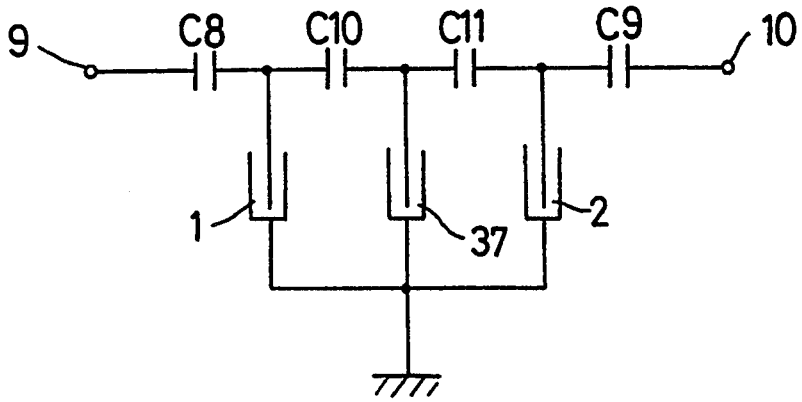
FIG. 19 is an equivalent circuit diagram of the fifth embodiment.
Figure 20:
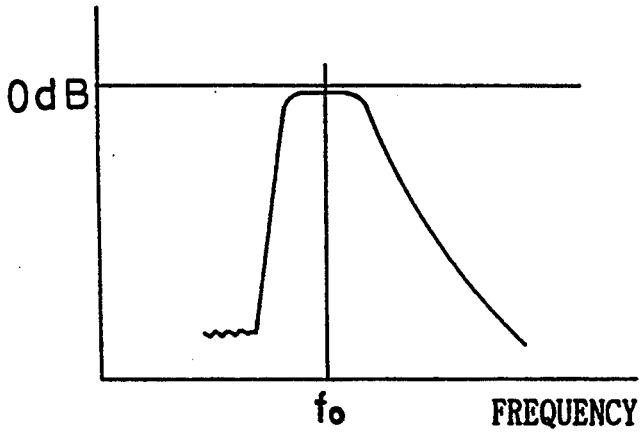
FIG. 20 is a graph showing the filter characteristics of the fifth embodiment.

FIG. 19 is an equivalent circuit diagram of the fifth embodiment. The inner conductors 6 of the resonators 1, 2 are capacitor-coupled to the respective input and output coupling strip lines 9, 10 by capacitances C8, C9, and the resonators 1, 37 and 2 are coupled to one another by capacitances C10 and C11 provided by interstage coupling windows 8. whereby a filter is constructed. FIG. 20 showing the filter characteristics of this embodiment reveals that the filter is more excellent in suppression in a low frequency range than those having two resonators.

Sixth Embodiment

Figure 21:
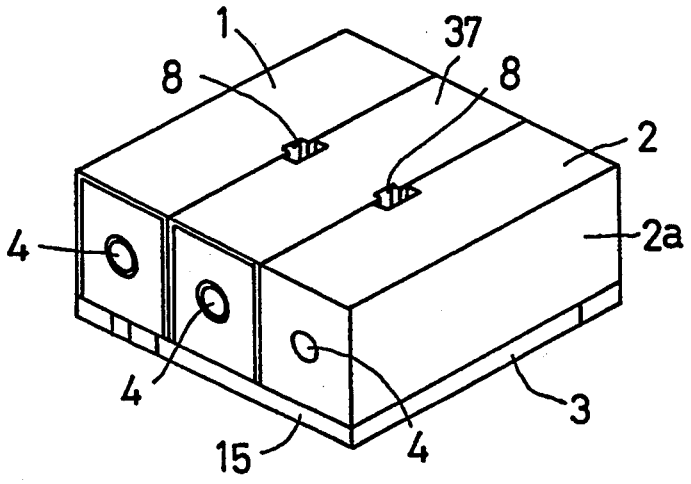
FIG. 21 is a perspective view showing a sixth embodiment.
Figure 22:
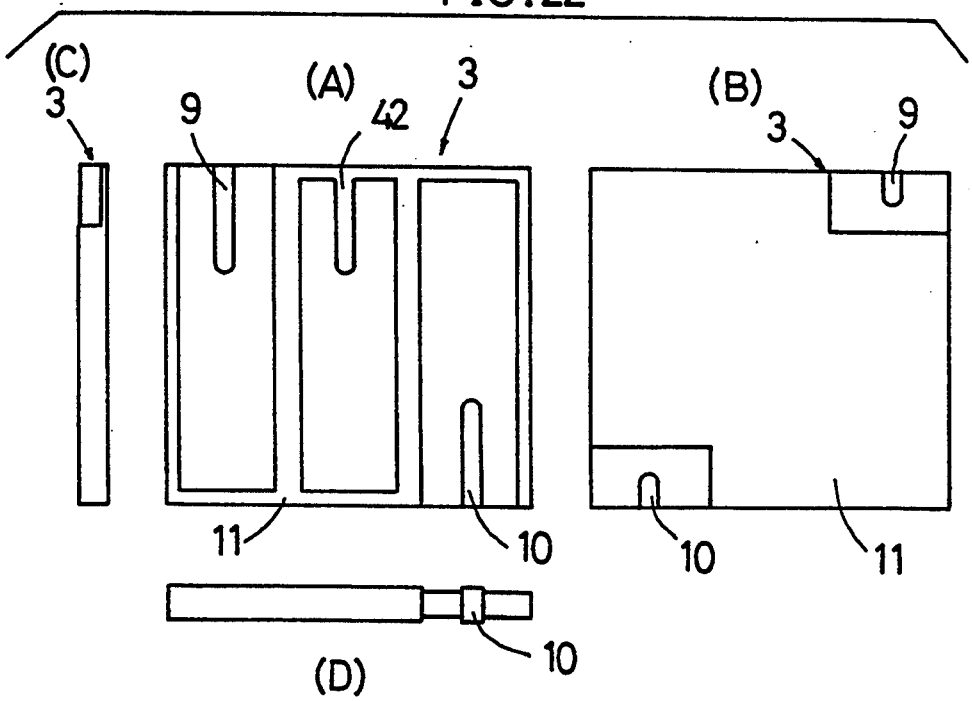
FIG. 22, (A) to (D) are projection drawings showing different surfaces of a dielectric substrate for use in the sixth embodiment.

FIG. 21 shows a sixth embodiment of the invention wherein three coaxial resonators are used. This embodiment differs from the fifth embodiment in that a dielectric substrate 3 has arranged thereon a coaxial resonator 1 of input stage and a coaxial resonator 37 of intermediate stage which are oriented in the same direction, and a coaxial resonator 2 of output stage which is oriented in a direction different from the above direction. The substrate 3 is provided with input and output coupling strip lines 9, 10 which are opposed to each other as seen in FIG. 22.

Figure 23:
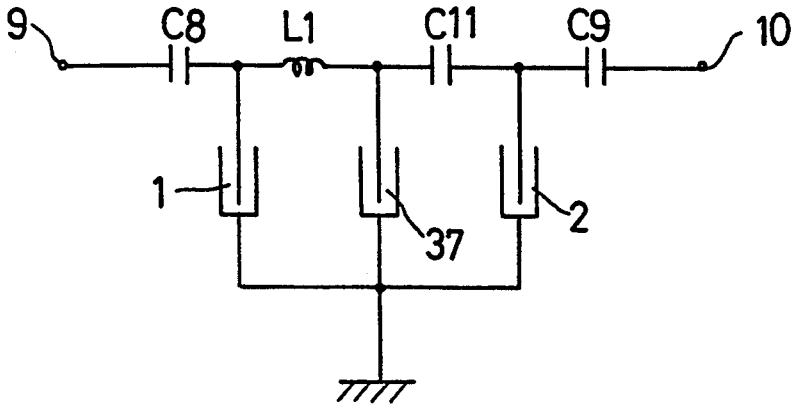
FIG. 23 is an equivalent circuit diagram of the sixth embodiment.
Figure 24:
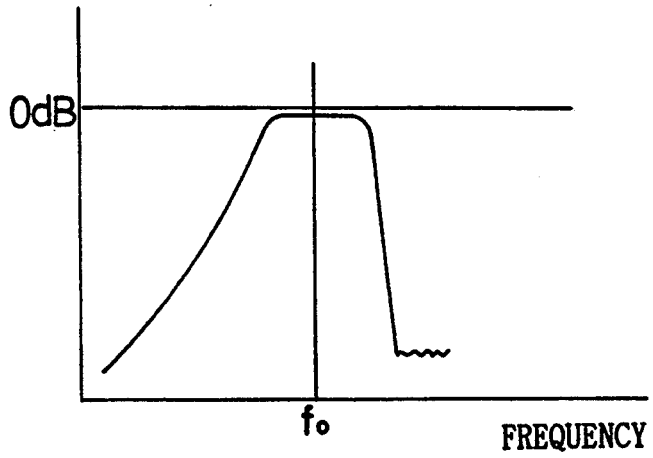
FIG. 24 is a graph showing the filter characteristics of the sixth embodiment.

FIG. 23 is an equivalent circuit diagram of the sixth embodiment. The inner conductors 6 of the coaxial resonators 1, 2 are capacitor-coupled to the respective input and output coupling strip lines 9, 10 by capacitances C8, C9, and the coaxial resonator 37 of intermediate stage is capacitor-coupled to the resonator 2 of output stage by a capacitance C11 provided by an interstage coupling window 8. On the other hand, since the resonators 1, 37 of input and intermediate stages have the same orientation, the magnetic field distributions concerned are in phase with the result that magnetic field coupling predominates to couple the resonators 1, 37 by an inductance L1. FIG. 24 showing the filter characteristics of this embodiment reveals that the filter is more excellent in suppression in a high frequency range than those having two resonators.

Seventh Embodiment

Figure 25:
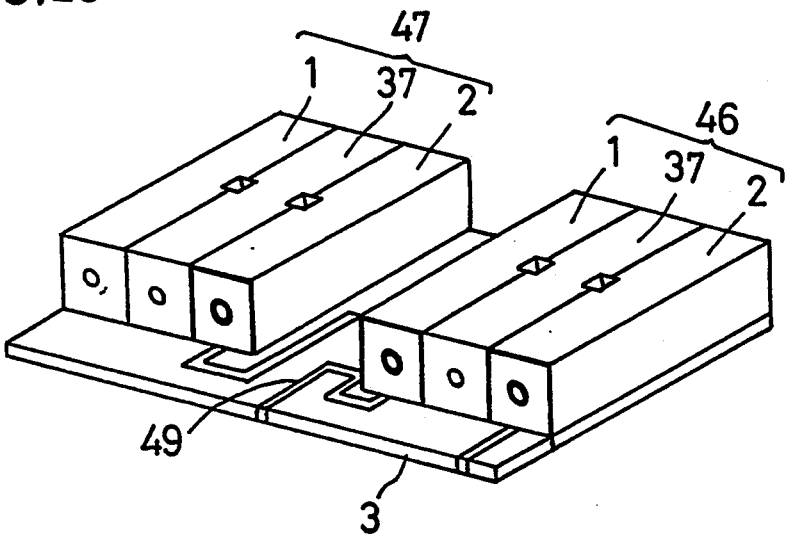
FIG. 25 is a view showing a duplexer as a seventh embodiment.

FIG. 25 shows a seventh embodiment of the present invention, i.e., a duplexer which comprises the dielectric filter of fifth embodiment of FIG. 17 as a transmitting (Tx) filter 46 and the dielectric filter of sixth embodiment of FIG. 21 as a receiving (Rx) filter 47. With this embodiment, a matching circuit 49 for connecting the transmitting (Tx) filter 46 and the receiving (Rx) filter 47 to a single antenna is formed by strip lines on a dielectric substrate 3, which has mounted thereon the coaxial resonators 1, 37 and 2 of input, intermediate and output stages to provide the duplexer.

Figure 26:
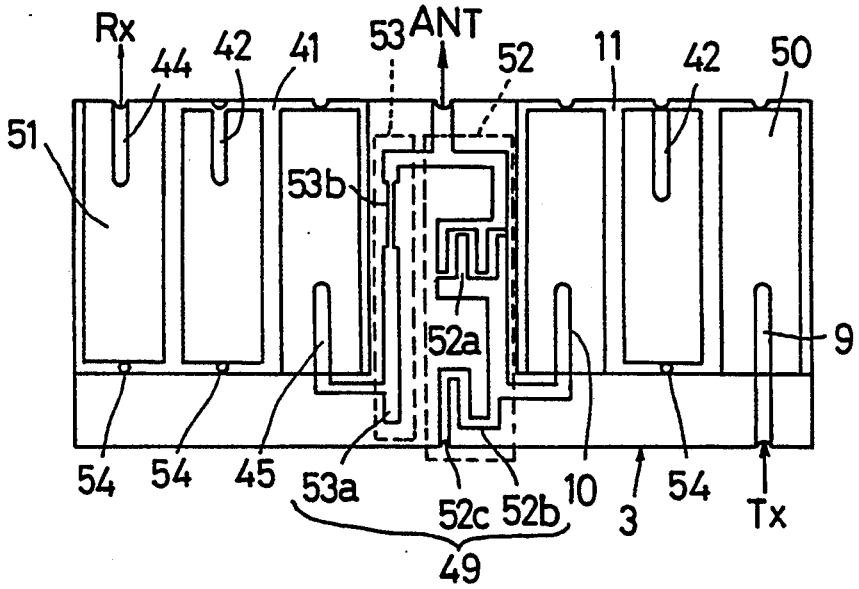
FIG. 26 is a plan view showing a dielectric substrate for use in the duplexer.

FIG. 26 shows the front surface of the substrate 3, which is formed with a pattern 51 for the transmitting (Tx) filter 46, pattern 51 for the receiving (Rx) filter 47, transmitting matching circuit 52 and receiving matching circuit 53. Each of the patterns 50, 51 for the respective filters is substantially the same as those of the fourth and fifth embodiments shown in FIGS. 18 and 22, and comprises input and output coupling strip lines 9, 10, a grounding electrode 11 formed around these lines and a resonator length correcting strip line 42. The grounding electrode 11 is electrically connected to a grounding electrode formed approximately over the entire rear surface of the substrate 3 by means of through holes 54. The transmitting matching circuit 52 and the receiving matching circuit 53 respectively comprise pattern capacitors 52*a*, 53*a* as capacitance means, and line inductors 52*b*, 53*b* as inductance devices. The line inductor 52*b* is connected to the grounding electrode on the rear surface via a through hole 52*c*.

Figure 27:
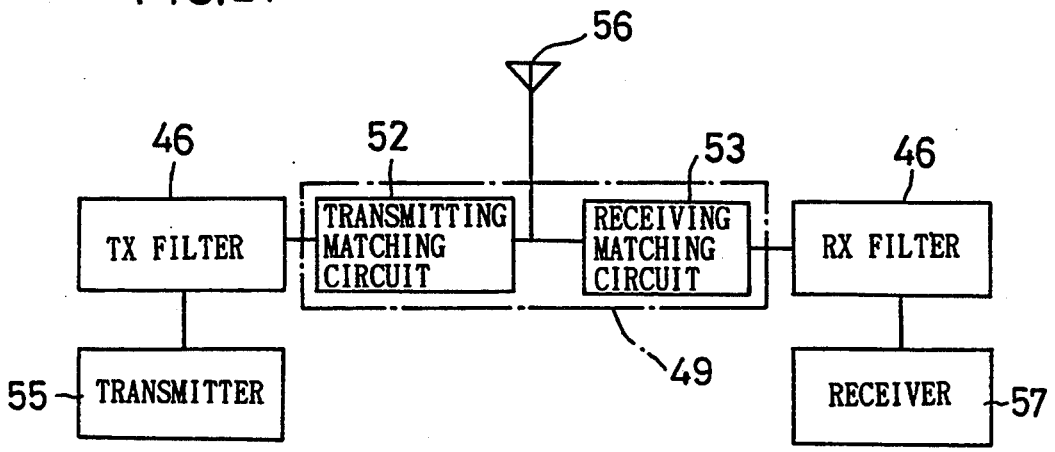
FIG. 27 is an equivalent circuit diagram schematically showing the duplexer.

FIG. 27 is a schematic equivalent circuit of the duplexer. Indicated at 57 and 55 are a receiver and a transmitter, respectively, and at 56 is the antenna.

With the duplexer of the present embodiment, the pattern 50 for the transmitting (Tx) filter 46, the pattern 51 for the receiving (Rx) filter 47 and the matching circuits 52, 53 can be formed in the single dielectric substrate 3.

As described above, the dielectric filter of the present invention comprises coaxial resonators which are arranged with their open end faces spaced apart and oriented alternately in opposite directions, and are mounted on a dielectric substrate shaped approximately in conformity with the shape of the bottom of the arrangement. This serves to provide more compact products. The characteristic impedance of the resonator differs between the open-end side and the short-circuit side to produce a change in higher-order resonance component to give improved higher-order pass band characteristics. Since the grounding electrode is formed so as to surround the input and output stip lines, the dielectric filter realized has outstanding filter characteristics free from interference between the input and the output.

The duplexer of the present invention comprises dielectric filters having the foregoing construction and serving as transmitting and receiving filters, and these filters can be provided on a single dielectric substrate along with matching circuits. The duplexer is therefore simplified in construction and easy to manufacture.

The embodiments described above are intended to illustrate the present invention and should not be construed as limiting the present invention defined in the appended claims or reducing the scope thereof. The devices of the present invention are not limited to the foregoing embodiments in construction but can of course be modified variously within the technical scope defined in the claims.

What is claimed is:

1. A dielectric filter comprising: a dielectric substrate having input and output coupling strip lines, and a plurality of coaxial resonators, each of the resonators comprising a dielectric member having a through hole, an outer peripheral surface and an inner peripheral surface, the outer and inner peripheral surfaces being covered with an electrically conductive material to provide an outer conductor and an inner conductor respectively, the outer conductor being partially removed, the resonator having an end face where the outer and inner conductors are short-circuited and an open end face where the outer and inner conductors are not connected to each other, the plurality of coaxial resonators including a pair of resonators serving as an input stage and an output stage and arranged on the dielectric substrate with their open end faces oriented in directions opposite to each other, the dielectric substrate being shaped in the dimensions of width and length substantially in conformity with a bottom contour of the plurality of resonators as arranged on the substrate; and wherein said pair of resonators serving as an input stage and an output stage are coupled to the input and output coupling strip lines, respectively.

2. A dielectric filter as defined in claim 1 wherein the dielectric substrate has a surface having the coaxial resonators arranged thereon and formed with a grounding electrode around the input and output coupling strip lines.

3. A dielectric filter as defined in claim 1 wherein an interstage coupling window is formed in the coaxial resonators adjacent to each other by removing a portion of the outer conductors of the resonators and extends perpendicular to a axial direction of the through hole, and the adjacent resonators are different in the axial width of the coupling window.

4. A dielectric filter as defined in claim 2 wherein a plurality of connecting portions formed in a side face of the dielectric substrate and electrically connected to the grounding electrode on the surface, and an electrically conductive cover is provided over the plurality of coaxial resonators and formed at one end thereof with comb-toothed connecting end portions; joined to the connecting portions in the substrate side face.

5. A dielectric filter as defined in claim 4 wherein the conductive cover is made of a copper alloy.

6. A dielectric filter as defined in claim 2 wherein said grounding electrode is formed on a rear surface of the dielectric substrate, and the outer conductors of the resonators are electrically coupled to the grounding electrode on the rear surface of the dielectric substrate to thereby control the position of a local amplitude minimum to be formed in a frequency attenuation region.

7. A dielectric filter as defined in claim 6 wherein through holes for interconnecting the grounding electrodes on the respective surfaces of the dielectric substrate are formed in opposite side faces of the dielectric substrate where the input and output coupling strip lines are not formed.

8. A dielectric filter as defined in claim 6 wherein a through-hole for interconnecting the grounding electrodes on the respective surfaces of the dielectric substrates is formed in one of opposite side faces of the dielectric substrate wherein said one of opposite side faces is formed with the input and output coupling strip lines.

9. A dielectric filter as defined in claim 1 wherein the input and output coupling strip lines extend in parallel to each other respectively from two opposite sides of the dielectric substrate in directions opposite to each other.

10. A dielectric filter comprising: a dielectric substrate having input and output coupling strip lines, and a plurality of coaxial resonators, each of the resonators comprising a dielectric member having a through hole, an outer peripheral surface and an inner peripheral surface, the outer and inner peripheral surfaces being covered with an electrically conductive material to provide an outer conductor and an inner conductor respectively, the outer conductor being partially removed, the resonator having an end face where the outer and inner conductors are short-circuited and an open end face where the outer and inner conductors are not connected to each other, the input and output coupling strip lines extend in parallel to each other from one side of the dielectric substrate toward the same direction, the plurality of coaxial resonators including resonators serving as an input stage and an output stage and arranged on the dielectric substrate with their open end faces oriented toward the side of the dielectric substrate having the strip lines, the plurality of coaxial resonators including a coaxial resonator of an intermediate stage having its open end face oriented in a direction opposite to the open end faces of the resonators of the input and output stages, each of the resonators being mounted on the dielectric substrate, the dielectric substrate being shaped in the dimensions of width and length substantially in conformity with a bottom contour of the plurality of resonators as arranged on the substrate; and wherein the resonators serving as an input stage and an output stage are coupled to the input and output coupling strip lines, respectively.

11. A dielectric filter as defined in claim 1 wherein the plurality of coaxial resonators includes a coaxial resonator of an intermediate stage having an open end face oriented in a direction of the open end face of the resonator of the input stage.

12. A dielectric filter as defined in claim 1 wherein the plurality of coaxial resonators includes a coaxial resonator of an intermediate stage having an open end face oriented in a direction opposite to the open end face of the resonator of the input stage.

* * * * *